US009808104B1

(12) United States Patent
Tran

(10) Patent No.: US 9,808,104 B1
(45) Date of Patent: Nov. 7, 2017

(54) ONE-PIECE CONSTRUCTION CHOPSTICKS

(71) Applicant: Tam P. Tran, San Diego, CA (US)

(72) Inventor: Tam P. Tran, San Diego, CA (US)

( * ) Notice: Subject to any disclaimer, the term of this patent is extended or adjusted under 35 U.S.C. 154(b) by 0 days.

(21) Appl. No.: 15/157,233

(22) Filed: May 17, 2016

(51) Int. Cl.
*A47G 21/02* (2006.01)
*A47G 21/06* (2006.01)

(52) U.S. Cl.
CPC ..... *A47G 21/103* (2013.01); *A47G 21/02* (2013.01)

(58) Field of Classification Search
USPC ..... 7/112; 30/122, 123
See application file for complete search history.

(56) References Cited

U.S. PATENT DOCUMENTS 3,884,456 A 5/1975 Lew
3,937,510 A 2/1976 Lew
4,973,095 A 11/1990 Kunihisa
8,782,907 B2 * 7/2014 Chong ..... A47G 21/06 30/142
9,004,565 B2 4/2015 Tran
2002/0096899 A1 7/2002 Kang
2004/0051327 A1 * 3/2004 Yoon ..... A47G 21/103 294/99.2
2004/0164573 A1 8/2004 Hao
2004/0212203 A1 10/2004 Calagui
2005/0082855 A1 4/2005 Baxter
2009/0066097 A1 3/2009 Lin et al.
2013/0200643 A1 * 8/2013 Marshall, III ..... A47G 21/10 294/106

* cited by examiner

*Primary Examiner* — Joseph J Hail
*Assistant Examiner* — Shantese McDonald
(74) *Attorney, Agent, or Firm* — Stevenson IP, LLC

(57) ABSTRACT

A one-piece construction chopsticks including symmetrical first and second portions connected to each other by a parallelepiped resilient member at a rear end thereof in a mirror image configuration. A hook on the second portion aligns and maintains positioning of the first and second portions and limits the size of an opening between a bottom side thereof. A pair of parallelelepiped rails perpendicularly disposed on a lower segment of the first portion guides and aligns the first and second portions. Interchangeable implements, such as a spoon, a fork, and a gripping tool, is attachable to the bottom side of each of the first and second portions. Thus, the present chopsticks secure a food particle between the gripping tools without the time and effort involved in developing the skills necessary to use conventional chopsticks, while also permitting the interchangeable use of an eating utensil, such as a spoon and a fork.

6 Claims, 6 Drawing Sheets

ONE-PIECE CONSTRUCTION CHOPSTICKS

BACKGROUND OF THE INVENTION

Various types of chopsticks are known in the prior art. Conventional chopsticks typically comprise two separate sticks that require skill to use. The present one-piece construction chopsticks include a first portion and a second portion, which are symmetrical and are connected to each other by a parallelepiped resilient member at a rear end thereof in a mirror image configuration. A hook on a second portion of the chopsticks properly aligns and maintains positioning of the first portion and a second portion of the chopsticks and limits the size of an opening between a bottom side of each of the first and second portions. A pair of parallel rails on the lower segment of the first portion assists in guiding and properly aligning the first and second portions, particularly when grasping a heavy food item, such as a Chinese dumpling. A plurality of interchangeable implements, such as a spoon, a fork, and a gripping tool, is attachable to the bottom side of each of the first and second portions. Thus, the present chopsticks secure a food particle between the gripping tools on each of the first and second portions without the time and effort involved in developing the skills necessary to use conventional chopsticks, while also permitting the interchangeable use of an eating utensil, such as a spoon and a fork.

FIELD OF THE INVENTION

The present invention relates to implements devised for the consumption of food, and more particularly, to one-piece construction chopsticks. A hook on a second portion of the chopsticks maintains proper aligned positioning of the first portion and a second portion of the chopsticks. A plurality of interchangeable implements, such as a spoon, a fork, and a gripping tool, is attachable to a bottom side of each of the first and second portions.

SUMMARY OF THE INVENTION

The general purpose of the present one-piece construction chopsticks, described subsequently in greater detail, is to provide a one-piece construction chopsticks which has many novel features that result in a one-piece construction chopsticks which is not anticipated, rendered obvious, suggested, or even implied by prior art, either alone or in combination thereof.

To accomplish this, the present one-piece construction chopsticks are devised to overcome the difficulties typically presented by chopsticks in the form of two separate sticks to grab and lift a food particle for consumption. To use two separate sticks, one must learn how to cross the sticks and manipulate the angle between the two sticks to apply pressure to the food particle in order to grasp the food particle. This learning process take time, dexterity, and eye-hand coordination. The present one-piece construction chopsticks overcomes the problems of two pieced chopsticks by providing a structure requiring only the application of pressure on a center area of the chopsticks. In addition, the present chopsticks provide a hook to assist in maintaining a proper sized gap for grasping the food particle. The present one-piece construction chopsticks includes a continuous body, which is in a substantially V-shaped position when the body is in an extended condition and which has an alternate contracted condition for grasping a food particle. The body includes a first portion and a second portion, which is a mirror image of the first portion, conjoined to the first portion. A substantially parallelepiped resilient member is disposed directly on a top side of the body. The resilient member directly conjoins the first portion and the second portion. The resilient member has a front wall, a rear wall, a top wall, a pair of side walls, and a convex bottom wall. Each of the front wall and the rear wall has a lower edge. Each of the first and second portions has a handle segment attached directly attached to the respective side wall and coplanar with the respective side wall. A raised lip is continuously disposed along each of a front edge and rear edge of the handle segment and a lower edge of the respective front wall and rear wall of the resilient member. A convex second segment is disposed directly on the bottom edge of the handle segment. The internal and external sides of the first portion are directed in an opposite direction from the internal and eternal sides of the second portion. A cylindrical third segment is disposed directly adjacent a lower end of the convex second segment and is coplanar therewith. The third segment has an upper end directly adjacent the lower end of the convex second segment. A lower segment of each of the first and second portions has an inwardly directed bend directly adjacent the third segment in a position opposite the second segment. The bend aligns the lower segment in an off-set position relative the handle segment and in a position more proximal an imaginary longitudinal midline axis than the handle segment.

The upper end of the third segment of the second portion has an outer side and a cylindrical hook spaced apart from and parallel to the outer side. The hook has an interior end disposed on the upper end of the third segment, an exterior end directed toward the second segment, and a gap between the hook and the outer side of the third segment. The third segment of the first portion is configured to engage the gap between the hook and the outer side of the third segment of the second portion of the body, which places the body in the alternate contracted condition. A pair of parallel rails on the lower segment of the first portion assists in guiding and properly aligning the first and second portions, particularly when grasping a heavy food item, such as a Chinese dumpling.

The one-piece construction chopsticks also includes an attachment piece having an inverted frustoconical member, which is centrally disposed on the bottom side of each of the first portion and the second portion and is in a position coplanar with the bottom side. The frustoconical member has an external end and an indented portion continuously disposed along the external end. A sphere, which has a flat internal end, is disposed on the external end of the frustoconical member. A parallelepiped guide protrusion is centrally disposed on the front side of the frustoconcial member between the bottom side and an approximate midpoint of the sphere. A plurality of implements is interchangeably engageable to the attachment piece. Each implement has a resilient upper connection portion and a lower portion. The upper connection portion has an uppermost end and a chamber disposed in the uppermost end. The chamber has a same shape and size as the attachment piece. The attachment piece is frictionally securable within the chamber of the respective implement. The plurality of implements includes at least a fork attachment, a spoon attachment, and a gripping tool having teeth on an exterior side proximal a lower edge thereof. When the body is in the alternate contracted condition with the third segment engaging the gap between the hook and the outer side of the third segment and the gripping tool is attached to the attachment piece, the teeth are directed toward each other thus enabling a user to grasp an object, such as a food particle, between the teeth.

Thus has been broadly outlined the more important features of the present one-piece construction chopsticks so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
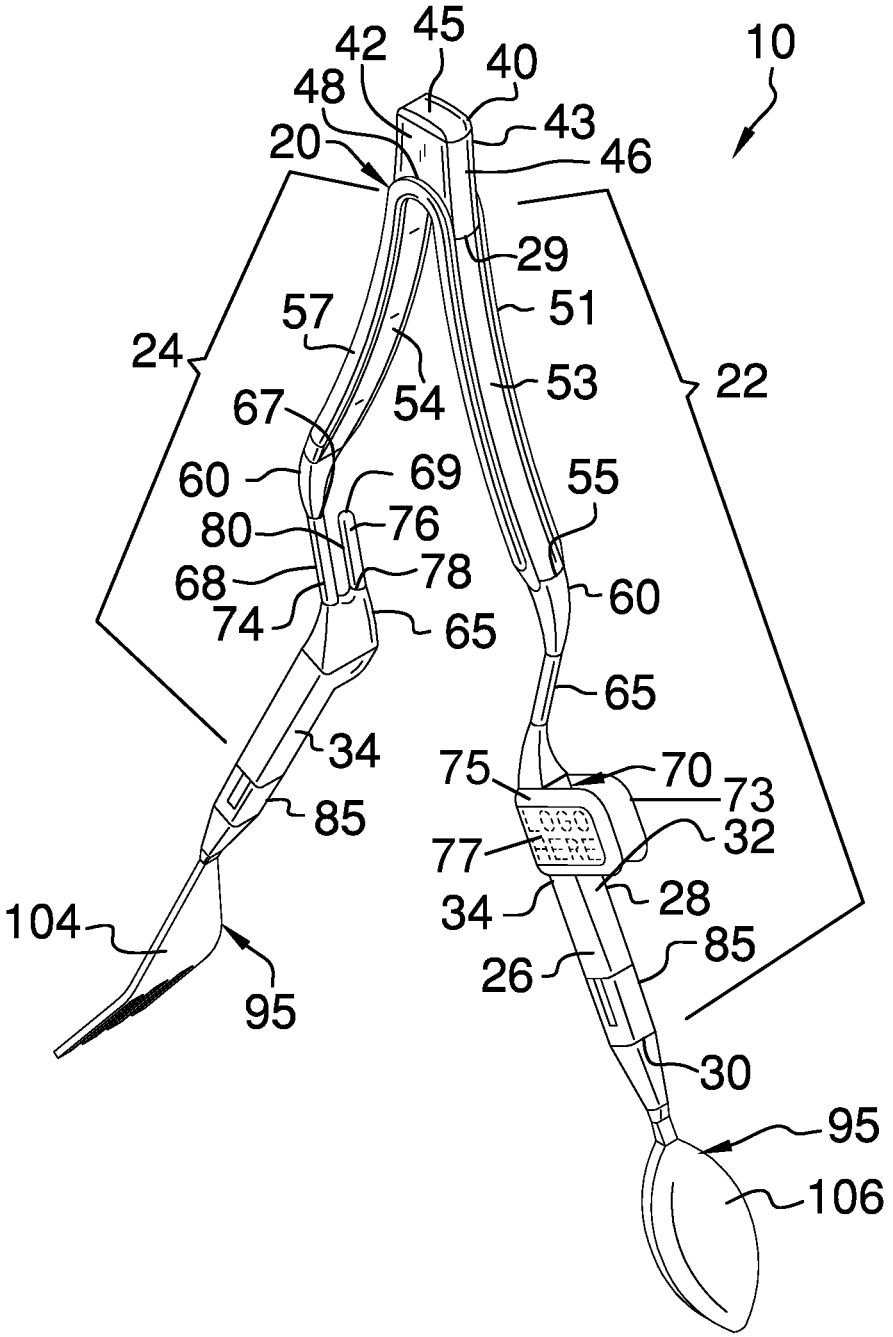
FIG. 1 is an isometric view.
Figure 2:
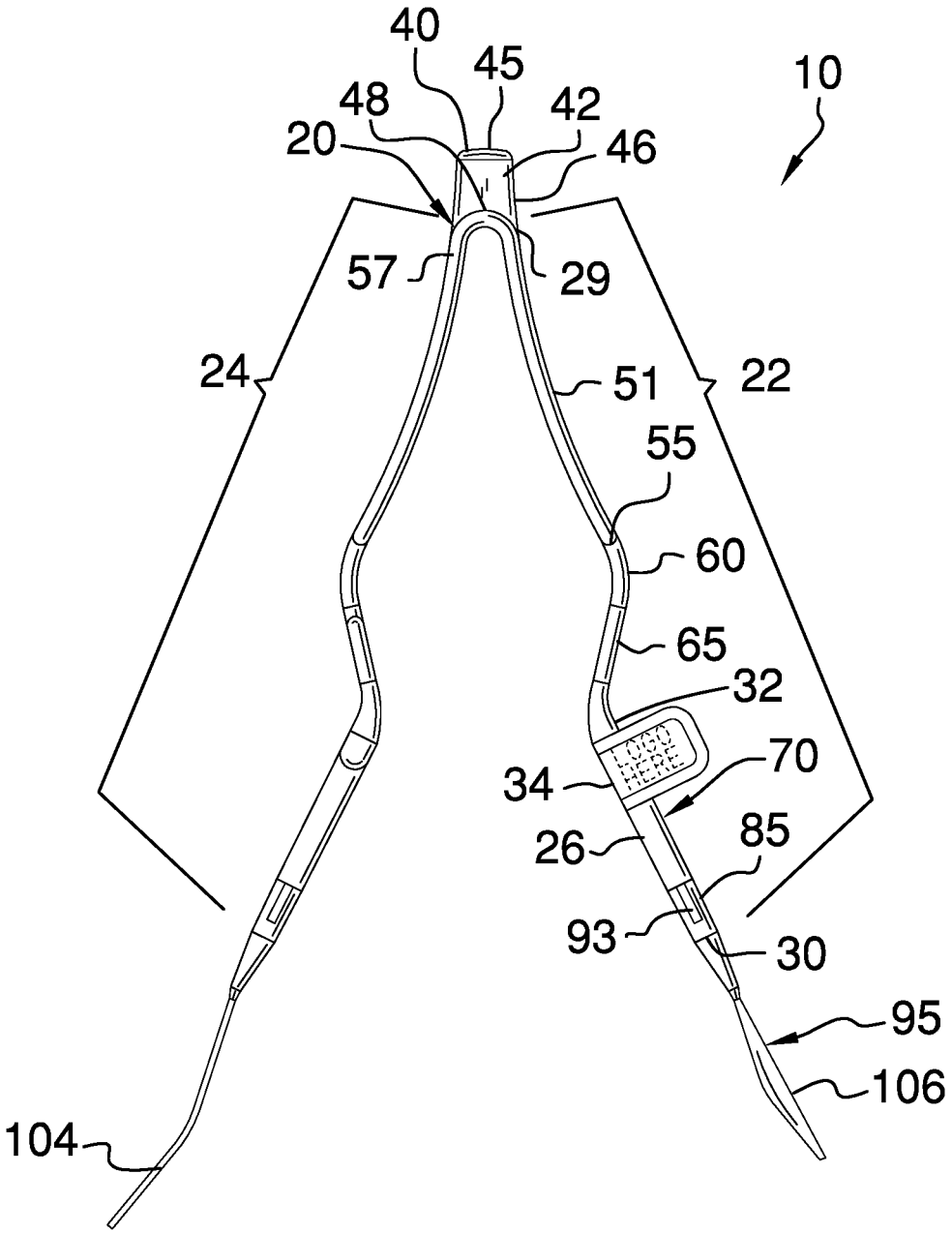
FIG. 2 is a front elevation view.
Figure 3:
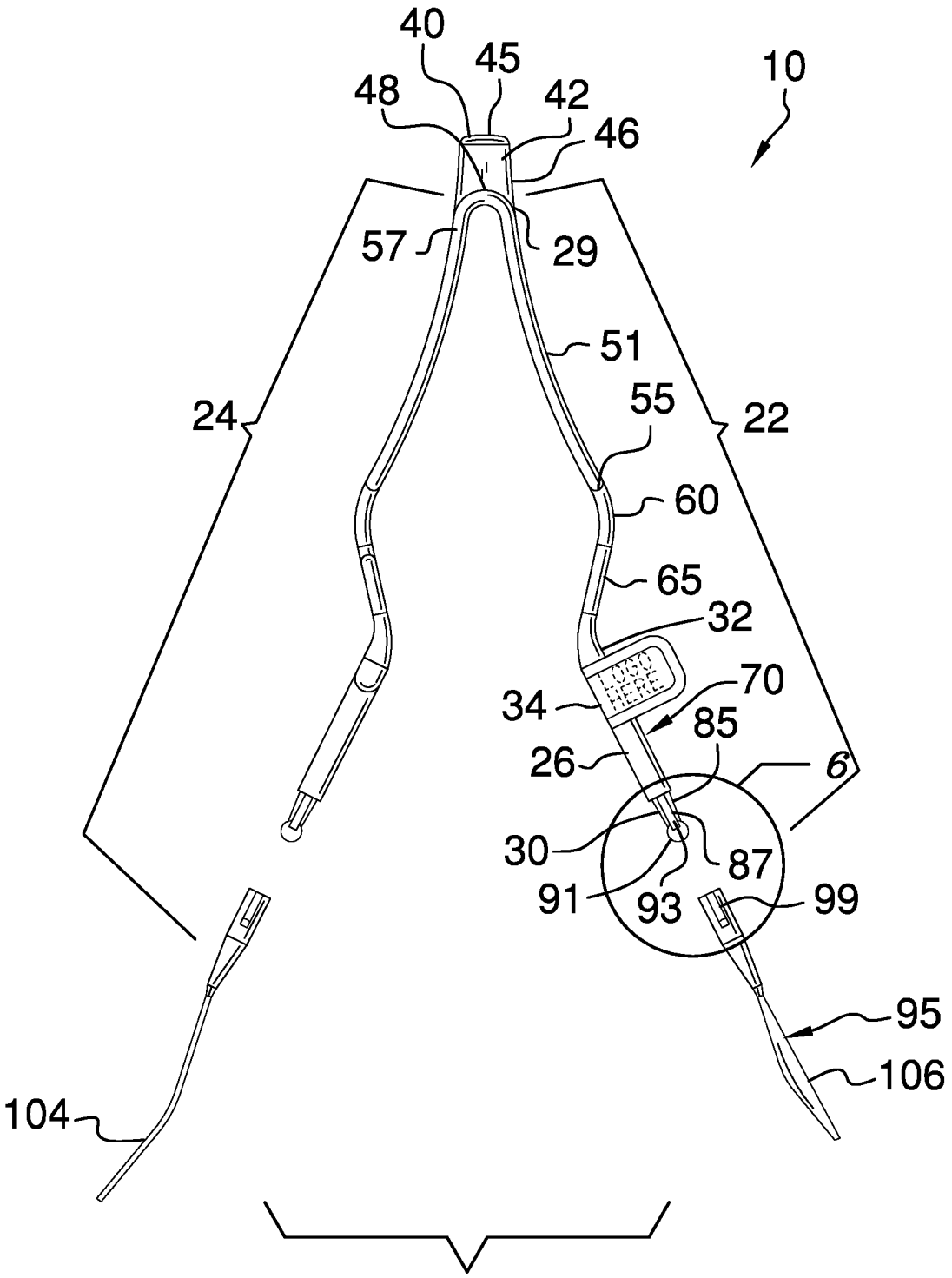
FIG. 3 is an exploded view showing attachable first and second implements of a plurality of implements.
Figure 4:
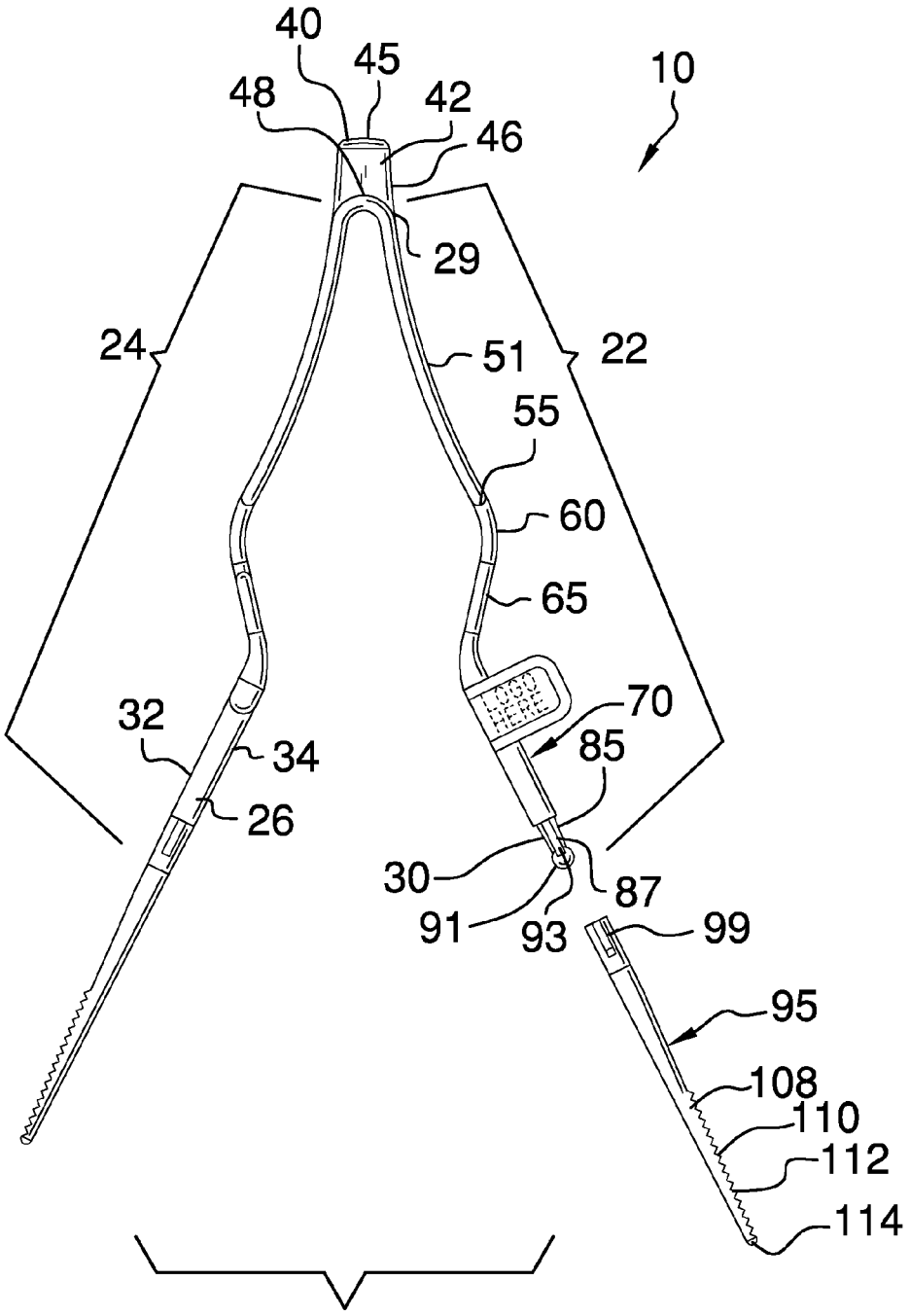
FIG. 4 is an exploded view showing an attachable third implement.
Figure 5:
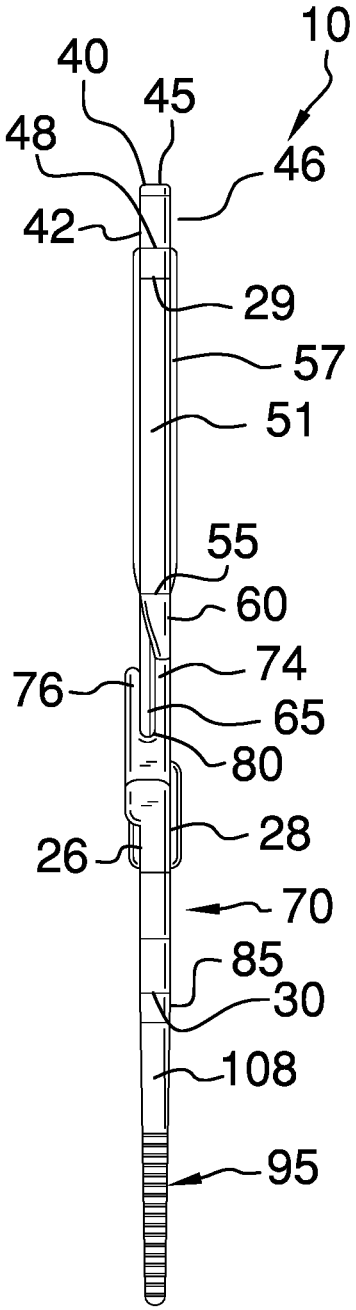
FIG. 5 is a side elevation view showing the attachable third implement.
Figure 6:
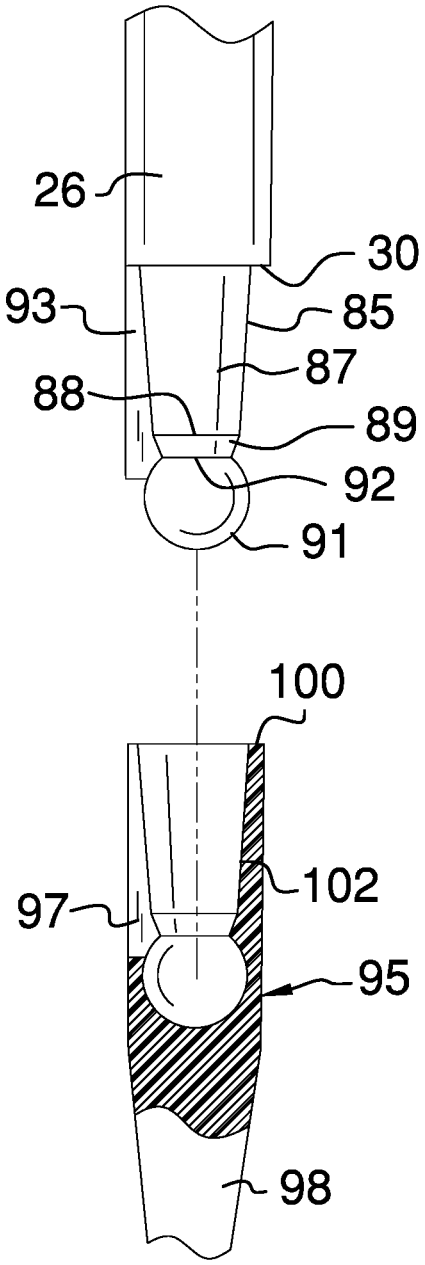
FIG. 6 is an exploded detail view taken from FIG. 3 with a partial cutaway showing the insertability of a ball attachment member disposed on a front side of a first portion within a channel of the second implement.

With reference now to the drawings, and in particular FIGS. 1 through 6 thereof, an example of the instant one-piece construction chopsticks employing the principles and concepts of the present one-piece construction chopsticks and generally designated by the reference number 10 will be described.

The one-piece construction chopsticks 10 includes a continuous body 20, which is in a substantially V-shaped position when the body 20 is in an extended condition. The body 20 further has an alternate contracted condition. The body 20 includes a first portion 22 and a second portion 24 conjoined to the first portion 22. The second portion 24 is a mirror image of the first portion 22. Each of the first portion 22 and the second portion 24 has a front side 26, a rear side 28, a top side 29, a bottom side 30, an external side 32, and an internal side 34. A substantially parallelepiped resilient member 40 is disposed directly on the top side 28. The resilient member 40 directly conjoins the first portion 22 and the second portion 24. The resilient member 40 has a front wall 42, a rear wall 43, a top wall 45, a pair of side walls 46, and a convex bottom wall 48.

Each of the first and second portions 22, 24 has a handle segment 51 attached directly attached to the respective side wall 46. Each handle segment 51 is coplanar with the respective side wall 46 and has a front edge 53, a rear edge 54, and a bottom edge 55. A raised lip 57 is continuously disposed along each of the front edge 53 and the rear edge 54 of the handle segment 51 and the bottom wall 48. The raised lip 57 assists in gripping the handle segment 51 and preventing the handle segment from slipping away from a user's fingers.

A convex second segment 60 is disposed directly on the bottom edge 55 of the handle segment 51. The internal and external sides 34, 32 of the first portion 22 are directed in an opposite direction from the internal and eternal sides 34, 32 of the second portion 24.

A cylindrical third segment 65 is disposed directly adjacent a lower end 67 of the convex second segment 60 and is coplanar therewith. The third segment 65 has an upper end 68 directly adjacent the lower end 67 of the convex second segment 60.

A lower segment 70 of each of the first and second portions 22, 24 has an inwardly directed bend 72 directly adjacent the third segment 65 in a position opposite the second segment 60. The bend 72 aligns the lower segment 70 in an off-set position relative the handle segment 51 and in a position more proximal an imaginary longitudinal midline axis than the handle segment 51. A pair of parallelelepiped rails 73 is disposed on the lower segment 70 of the first portion 22 in a position perpendicuilar to the lower segment 70. One of each of the pair of the rails 73 is disposed on one of the front side 26 and the rear side 28. The rails 73 are parallel to each other. The pair of rails 73 assists in guiding and properly aligning the first and second portions, particularly when grasping a heavy food item, such as a Chinese dumpling. Each rail 73 has a continuous raised outer edge 75. A logo 77 may also be displayed on each of the rails 73.

The upper end 68 of the third segment 65 of the second portion 24 has an outer side 74 and a cylindrical hook 76 spaced apart from and parallel to the outer side 74. The hook 76 has an interior end 78 disposed on the upper end 68 of the third segment 65, an exterior end 79 directed toward the second segment 60, and a gap 80 between the hook 76 and the outer side 74 of the third segment 65. The third segment 65 of the first portion 22 is configured to engage the gap 80 between the hook 76 and the outer side 74 of the third segment 65 of the second portion 24 of the body 20, which places the body 20 in the alternate contracted condition.

The one-piece construction chopsticks 10 also includes an attachment piece 85. The attachment piece 85 includes an inverted frustoconical member 87, which is centrally disposed on the bottom side 30 of each of the first portion 22 and the second portion 24 and is in a position coplanar with the bottom side 30. The frustoconical member 87 has an external end 88 and an indented portion 89 continuously disposed along the external end 88. A sphere 91, which has a flat internal end 92, is disposed on the external end 88 of the frustoconical member 87. A parallelepiped guide protrusion 93 is centrally disposed on the front side 26 of the frustoconcial member 87 between the bottom side 30 and an approximate midpoint of the sphere 91.

A plurality of implements 95 is interchangeably engageable to the attachment piece 85. Each implement 85 has a resilient upper connection portion 97, a lower portion 98, and a guide slot 99 disposed in the upper connection portion 97. The guide protrusion is engageable within the guide slot 99. The upper connection portion 97 has an uppermost end 100 and a chamber 102 disposed in the uppermost end 100. The chamber 102 has a same shape and size as the attachment piece 85. The attachment piece 85 is frictionally securable within the chamber 102 of the respective implement 95. The plurality of implements 95 includes at least a fork attachment 104, a spoon attachment 106, and a gripping tool 108 having teeth 110 on an exterior side 112 proximal a lower edge 114 thereof. When the body 20 is in the alternate contracted condition with the third segment 65 engaging the gap 80 between the hook 76 and the outer side 74 of the third segment 65 and the gripping tool 108 is attached to the attachment piece 85, the teeth 110 are directed toward each other thus enabling a user to grasp an object, such as a food particle, between the teeth 10.

What is claimed is:

1. A one-piece construction chopsticks comprising:

a continuous body, the body being in a substantially V-shaped position when the body is in an extended condition, the body further having an alternate contracted condition, the body comprising:

a first portion;

a second portion conjoined to the first portion, the second portion being a mirror image of the first portion;

each of the first portion and the second portion having a front side, a rear side, a top side, a bottom side, an external side, and an internal side;

a substantially parallelepiped resilient member disposed directly on the top side, wherein the resilient member directly conjoining the first portion and the second portion, the resilient member having a front wall, a rear wall, a top wall, a pair of side walls, and a convex bottom wall;

a handle segment of each of the first portion and the second portion, each handle segment attached directly attached to the respective side wall, each handle segment being coplanar with the respective side wall and having a front edge, a rear edge, and a bottom edge;

a raised lip continuously disposed along each of the front edge and the rear edge of the handle segment and the bottom edge;

a convex second segment disposed directly on the bottom edge of the handle segment, wherein the internal and external sides of the first portion are directed in an opposite direction from the internal and eternal sides of the second portion;

a cylindrical third segment disposed directly adjacent a lower end of the convex second segment, the third segment being coplanar with the lower end of the convex second segment, the third segment having an upper end directly adjacent the lower end of the convex second segment; and a lower segment having an inwardly directed bend directly adjacent the third segment in a position opposite the second segment, wherein the bend aligns the lower segment in an off-set position relative the handle segment and in a position more proximal an imaginary longitudinal midline axis than the handle segment.

2. The one-piece construction chopsticks of claim 1 comprising:

wherein the upper end of the third segment of the second portion has an outer side and a cylindrical hook spaced apart from and parallel to the outer side, the hook having an interior end disposed on the upper end of the third segment, an exterior end directed toward the second segment, and a gap between the hook and the outer side of the third segment; and wherein the third segment of the first portion is configured to engage the gap between the hook and the outer side of the third segment of the second portion of the body.

3. The one-piece construction chopsticks of claim 1 comprising an attachment piece, the attachment piece comprising:

an inverted frustoconical member centrally disposed on the bottom side of each of the first portion and the second portion and being in a position coplanar with the bottom side, the frustoconical member having an external end and an indented portion continuously disposed along the external end;

a sphere having a flat internal end disposed on the external end of the frustoconical member;

a parallelepiped guide protrusion centrally disposed on the front side of the frustoconcial member between the bottom side and an approximate midpoint of the sphere;

a plurality of implements interchangeably engageable to the attachment piece, each implement having a resilient upper connection portion and a lower portion, the upper connection portion having an uppermost end and a chamber disposed in the upper most end, the chamber having a same shape and size as the attachment piece, wherein the attachment piece is frictionally securable within the chamber of the respective implement.

4. The one-piece construction chopsticks of claim 3 wherein the plurality of implements includes at least a fork attachment, a spoon attachment, and a gripping tool having teeth on an exterior side proximal a lower edge thereof.

5. The one-piece construction chopsticks of claim 1 comprising:

a pair of paralleleleppiped rails is disposed on the lower segment of the first portion in a position perpendicuilar to the lower segment, one of each of the pair of the rails being disposed on one of the front side and the rear side, wherein the rails are parallel to each other.

6. The one-piece construction chopsticks of claim 5 wherein each rail has a continuous raised outer edge.

* * * * *